United States Patent [19]

Wood

[11] Patent Number: 4,978,018

[45] Date of Patent: Dec. 18, 1990

[54] TRASH CONTAINER AND BAG LINER SORTER

[76] Inventor: Charles L. Wood, 1619 Ryder Cup Dr., Westlake Village, Calif. 91362

[21] Appl. No.: 381,857

[22] Filed: Jul. 19, 1989

[51] Int. Cl.[5] ..... B65D 90/00

[52] U.S. Cl. ..... 220/1 T; 220/22.1; 220/22.2

[58] Field of Search ..... 220/22.4, 1 T, 22.1, 220/22.2

[56] References Cited

U.S. PATENT DOCUMENTS

| | | | |
|---|---|---|---|
| 2,081,078 | 5/1937 | Watson | 220/22.3 X |
| 2,221,024 | 11/1940 | Hood | 220/22.3 |
| 2,435,077 | 1/1948 | Hall et al. | 220/22.2 |
| 2,789,562 | 4/1957 | Norris, Sr. | 220/22.3 |
| 4,436,215 | 3/1984 | Kleinert et al. | 220/22.2 X |
| 4,826,013 | 5/1989 | Heikkinen | 220/1 T X |
| 4,867,328 | 9/1989 | McCarthy | 220/22.1 X |
| 4,874,111 | 10/1989 | Heller | 220/1 T X |

*Primary Examiner*—Steven M. Pollard
*Attorney, Agent, or Firm*—Staas & Halsey

[57] ABSTRACT

A waste container has two dividers which are adjustably mounted in the interior of the container to compartmentalize the interior for receiving segregated types of trash. Guides are provided to adjust the angle of orientation of each divider, while a detachable coupling is provided in the bottom of the container for optionally removing the dividers and allowing for pivotal movement thereof to adjust the angular orientation.

14 Claims, 2 Drawing Sheets

TRASH CONTAINER AND BAG LINER SORTER

BACKGROUND OF THE INVENTION

1. Field of the Invention

This invention relates generally to trash containers and, more specifically, to a novel flexible compartmentalized trash container for sorting and storing different types of recyclable waste materials such as cans, glass and other waste materials typically found in households. Sorting waste materials into recyclable and non-recyclable containers at the source of the waste generation point should increase compliance with existing and expected new government regulations. The household is a significant source of potential recyclable materials which this patent addresses.

2. Description of the Related Art

Historically, landfills and burning methods have been used to dispose of most trash, waste and other garbage. The amount of waste, scarce landfills sites, scarce resources and clean air regulations have resulted in changes in government policies towards disposal of waste. Most studies and generally available information indicate that a key stumbling block to gaining full public support for new recycling regulations is not from public apathy, but the current limitations on separating the various materials. Most households and businesses have limited floorspace to accommodate more bulky or multiple conventional trash containers.

Typically, smaller waste containers, which are lined with plastic bags, are used to store daily accumulations of trash. The bags are routinely removed from the containers and placed in larger containers in the garage or other storage locations while waiting to be collected by municipal or private trash vehicles. The trash vehicles transport the individually collected trash to a disposal site. In many municipalities across the United States regulations are being enacted requiring each household or business to separate various types of waste, trash and garbage materials. These programs are directed at preventing recyclable materials such as glass, cans, plastic and paper from being sent to landfills or incinerators. In order to comply with the trash material separation requirements, businesses and households use individual containers for each recyclable item. This is extremely inconvenient and has resulted in very slow public acceptance of the new regulations. Higher levels of acceptance will not occur until the sorting of the materials becomes more convenient.

SUMMARY OF THE INVENTION

An object of the present invention is to provide a waste container which allows the user the flexibility to vary the size of each section of a compartmentalized waste container.

Another object of the present invention is to provide the user the flexibility of using a container as a conventional container by removing separator panels or inserting panels for use as a compartmentalized container.

Another object of the present invention is to provide convenient and cost effective stacking of containers for shipment and warehouse storage, wherein the bottom of each container is inserted into the top of another container. The separators panels and lids are stored and shipped as separate items inside the containers.

Another object of the present invention is to provide the user with a liner which may be used to line either a compartmentalized or conventional waste container.

This liner provides side stiffeners to act as pockets to assist in separating various classifications of trash materials when used in conjunction with either type container.

Another object of the present invention is to provide the user with a convenient means of separating the liner pockets into completely separate bags which contain unique classes of trash materials or to leave the liner intact as a single unit.

Another object of the present invention is to provide a combination system of specialized waste container and a container liner which maximizes the potential for recycling.

DETAILED DESCRIPTION OF THE PREFERRED EMBODIMENTS

Figure 1:
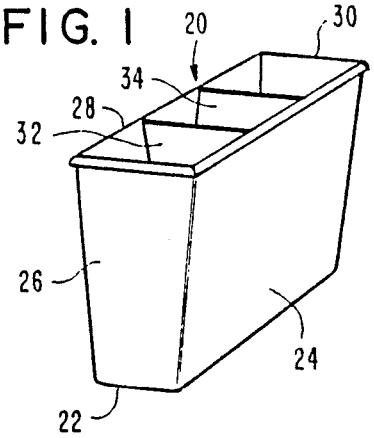
FIG. 1 is a perspective view of a waste container according to a preferred embodiment of the present invention with two separator panels.

Referring to FIG. 1, a waste container is generally referred to by the numeral 20 and includes a bottom 22, side walls 24, 26, 28 and 30 extending upwardly from the bottom and terminating in an open top. An interior of the waste container 20 is defined by the side walls 24, 26, 28, 30 and the bottom 22. The interior is compartmentalized by at least one divider, such as dividers 32 and 34, each divider being movably and adjustably mounted in the interior space formed by the side walls and bottom.

The container is made of molded plastic or rubber material and is preferably rectangular in shape so that the elongated side walls 24 and 28 taper slightly from top to bottom. The dividers are used selectively to establish separate sections for sorting recyclable material according to waste material classifications. The panels may be positioned in the container by sliding them vertically downwardly through a series of channels provided along an inner surface of the opposed side walls of the container, or adjusting the panels between a series of protrusions. In either embodiment, the panels may be pivotally mounted at the bottom of the container with a snap-in hinge or hinges, as will be described in greater detail below.

Figure 2:
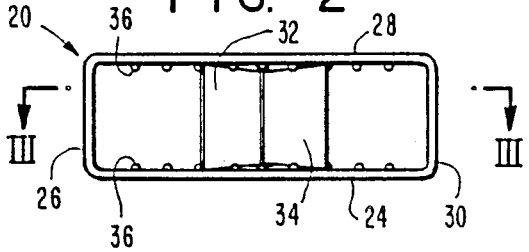
FIG. 2 is a top view of a bump guide embodiment of the waste container, showing the bump guides for the separator panels which are molded or attached to both the front and back walls of the container.

Referring to FIG. 2, the waste container 20 of the protrusion embodiment is illustrated as having a series of paired protrusions formed on inner surfaces of the two opposed side walls 24 and 28. The paired series of protrusions provide guide means for positionally fixing an angle or orientation with respect to each divider. Given that the preferred material is flexible or resilient, the side walls can be pushed radially outwardly until the desired angle of orientation is achieved, whereupon the respective divider will rest between two adjacent protrusions 36 of the series.

Figure 3A:
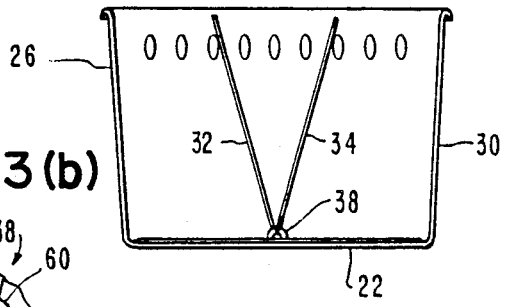
FIG. 3 is a cut away front view of the bump guide version waste container.
Figure 3B:
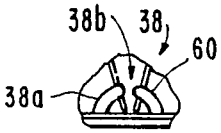
Figure 6:
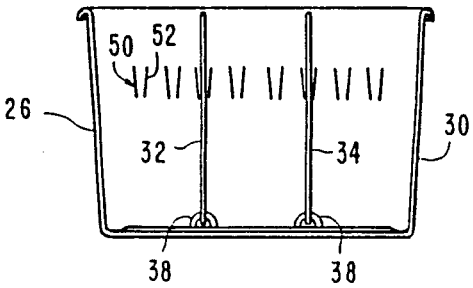
FIG. 6 is a cut away front view of the FIG. 5 channel guide version waste container.

A pivotal connection is provided at the bottom 22 so that each panel may be detachably coupled within the interior. Preferably, a hinge 38 includes a first portion 38*a* is integrally molded with the bottom 8*a* and extends upwardly therefrom which is snap-fitted into a corresponding opening in the bottom of each divider. The opening constitutes a complementary second portion of the hinges. In one embodiment, a single pair of hinges 38 is provided medially on the bottom 22, while in the another embodiment, it is possible to provide two pairs of hinges (FIG. 6) which are equidistantly spaced from the end walls 26 and 30. For each hinge 38, the first portion 38*a* is a U-shaped clip having a central opening 38*b* (FIG. 3) through which the lower ends of the dividers are inserted.

Figure 4:
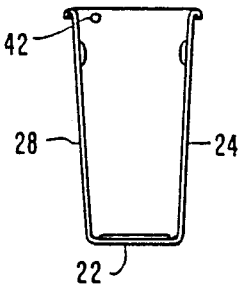
FIG. 4 is a cut away side view of the bump guide version waste container.
Figure 11:
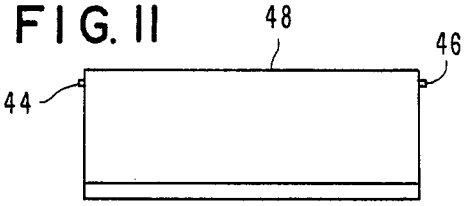
FIG. 11 is the top view of a free swinging top container lid used in the container according to the present invention.
Figure 12:
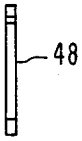
FIG. 12 is a side view of the lid of FIG. 11.

Referring to FIG. 4, a lip 40 surrounds the top opening of the container, adds structural rigidity to the container. A pair of holes 42 are provided in the opposite end walls 26 and 30 receive mounting pintles 44 and 46 of a lid 48 (see FIG. 11). The lid covers the opening of the container.

Figure 5:
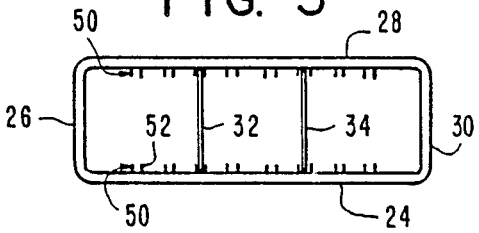
FIG. 5 is a top view of a channel guide version of the waste container with the channel guides molded or attached to both the front and back walls of each container.
Figure 7:
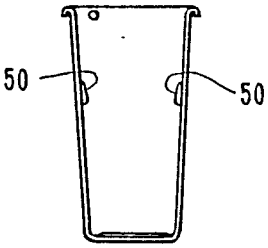
FIG. 7 is a cut away side view of the FIG. 5 channel guide version waste container.

FIG. 5 is a top view of an alternative embodiment where a series of paired slots 50 are provided instead of the protrusions 36. Each slot 50 is formed by a pair of adjacent guides 52 which are preferably integrally molded to the opposite side walls 24 and 28. In the embodiment using the guides, it is preferable to provide two hinges 38 since the range of angular movement of the dividers 32 and 34 is restricted by the length of guides 52.

Figure 8:
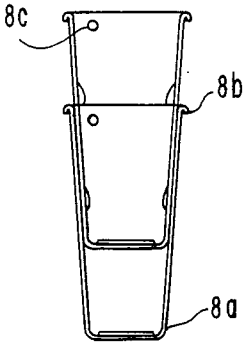
FIG. 8 is a stacked view of plural waste containers.

FIG. 8 illustrates how the tapered side walls allows containers to be stacked on top of one another for shipment and warehouse storage, with the lids removed. As previously mentioned, the container lip provides strength to the container opening and also provides a basis for frictional attachment of the container liners.

Figure 9:
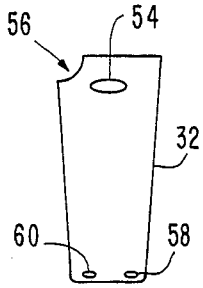
FIG. 9 is a side view of a separator panel according to the present invention.
Figure 10:
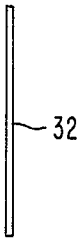
FIG. 10 is a front view of the separator panel of FIG. 9.

FIGS. 9 and 10 illustrate one of the dividers, such as dividers 32. Preferably, two dividers are provided for each container, although the dividers may be removed so as to provide a basic rectangular trash container. Each divider has a handle 54 which is formed by an opening provided in an upper portion of the separator panel. The handle 54 enables one to grasp the divider for the insertion into the container to thus couple and uncouple the panel from its snap-fit hinge at the bottom of the container. A cut away portion 56 is provided to enable mounting of the lid on top of the container. A pair of holes 58 and 60 are provided at the bottom of the divider 32 for receiving the hinge portions 8*a*. Thus, each hinge detachable coupling means constitutes a pair of hinges 38 arranged transversely on the bottom of the container. When more than one pair of hinges is required, as in FIG. 6, two pairs of hinges are needed, with each pair being spaced longitudinally along the bottom.

Figure 13:
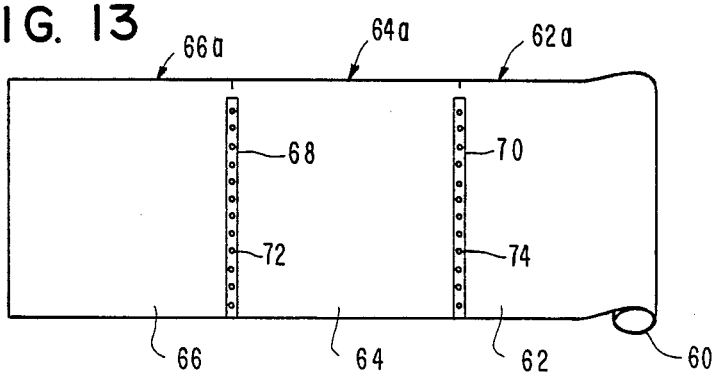
FIG. 13 is a front view of a partially unrolled series of contiguous trash bag liners.

FIG. 13 is a front view of a partially unrolled series of contiguous trash bag liners, with the numeral 60 denoting a roll, and the numerals 62, 64 and 66 denoting contiguous trash bag liners. Each bag is separated by the next by a heat seal 68 and 70, and a row of perforations 72 and 74. The perforations 72 and 74 provide score lines for tearing and separating the bags. Each bag 62, 64 and 66 is provided with an opening 62A, 64A and 66A for receiving trash. Preferably, three bags are unrolled and detached from the roll and placed within the container 20 in either an attached-together state, or a separated state. When the dividers are removed, or when the user has a conventional container, the bags may be inserted into the container in an attached state so that segregation of the trash can be achieved. After filling, the bags can be removed and separated along the perforations.

In FIG. 13, since the heat seals 68 and 70 are bifurcated by the score lines 72 and 74, tearing along the score lines will leave half a heat seal on each side, thereby maintaining the integrity of the bag.

Figure 14:
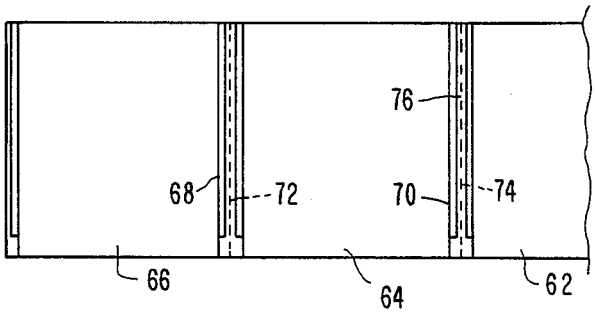
FIG. 14 illustrates how the user who only has a traditional trash container without separator panels can still use the bags for sorting trash.

In FIG. 14, an embodiment which is preferred for divider-list use includes an addition to the heat seals 68 and 70, a stiffener 76 which is heat sealed along each seam. The stiffener can be any suitable material which is light-weight and inexpensive, such as a strip of plastic. The strips are preferably in a pair with one of the pair on each side of the score line.

The many features and advantages of the present invention are apparent from the detailed specification and thus, it is intended by the appended claims to cover all such features and advantages of the waste container which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modifications and equivalents may be resorted to falling within the scope and the spirit of the invention.

What is claimed is:

1. A household waste container comprising:

a bottom;

two opposite side walls and two opposite end walls extending upwardly from the bottom and terminating in an open top, the bottom, two side walls and two end walls forming an interior space;

at least one divider removably and adjustably mounted in the interior space;

guide means disposed in the interior space for positionally fixing an angle of orientation with respect to each at least one divider; and detachable coupling means, disposed within the interior, for detachably coupling each at least one divider within the interior, wherein the detachable coupling means comprises at least one hinge having a first portion formed on the bottom of the container and a complementary second portion formed on the at least one divider.

2. A waste container as claimed in claim 1, wherein the guide means comprises a series of paired protrusions formed along the opposite side walls on inner surfaces thereof.

3. A waste container as claimed in claim 1, wherein each guide comprises a pair of spaced apart tracks formed along the opposite side walls near the top of the container.

4. A waste container as claimed in claim 1, wherein the pivotal coupling means comprises a hinge disposed on the bottom of the container and coupling to a bottom of each at least one divider.

5. A waste container as claimed in claim 4, wherein the hinge includes a clip which snap-fits into openings provided in the bottom of each at least one divider.

6. A waste container as claimed in claim 1, wherein the at least one divider comprises two dividers having a common pivotal connection at the bottom of the container through the detachable coupling means.

7. A waste container as claimed in claim 1, wherein the at least one divider comprises two dividers having separate pivotal connections at points equidistantly spaced longitudinally on the bottom of the container.

8. A waste container as claimed in claim 1, further comprising a lid pivotally connected to an upper portion of the two opposite side walls and covering the open top of the container.

9. A waste container as claimed in claim 8, further comprising a removable and throw-away trash bag disposed in each of the plurality of compartments.

10. A waste container as claimed in claim 8, wherein the at least one divider has a cut away portion which facilitates pivotal movement of the lid.

11. A waste container as claimed in claim 1, wherein the at least one divider compartmentalizes the interior space by forming a plurality of compartments.

12. A waste container as claimed in claim 11, wherein each trash bag is frangibly connected to each other along an adjacent edge.

13. A waste container as claimed in claim 1, wherein the first portion the at least one hinge is a U-shaped clip having a central opening through which a lower end of the at least one divider is inserted, and the second portion of the at least hinge is an opening formed in the lower end of the at least one divider.

14. A waste container as claimed in claim 1, wherein the first and second portions of the at least one hinge are snap-fitted together.

* * * * *